US008931126B1

(12) United States Patent
Xu

(10) Patent No.: US 8,931,126 B1
(45) Date of Patent: Jan. 13, 2015

(54) SLIDING BLOCK LINKAGE FOLDING BED

(71) Applicant: Jianchun Xu, Jiaxing (CN)

(72) Inventor: Jianchun Xu, Jiaxing (CN)

( * ) Notice: Subject to any disclaimer, the term of this patent is extended or adjusted under 35 U.S.C. 154(b) by 0 days.

(21) Appl. No.: 14/300,925

(22) Filed: Jun. 10, 2014

(30) Foreign Application Priority Data

Jul. 5, 2013 (CN) ..... 2013 1 0281317

(51) Int. Cl.
*A61G 7/015* (2006.01)

(52) U.S. Cl.
USPC ..... 5/616; 5/613

(58) Field of Classification Search
USPC ..... 5/616–619, 613
See application file for complete search history.

(56) References Cited

U.S. PATENT DOCUMENTS 942,354 A * 12/1909 Ryan ..... 5/634
2002/0174487 A1* 11/2002 Kramer et al. ..... 5/618

* cited by examiner

*Primary Examiner* — Fredrick Conley
(74) *Attorney, Agent, or Firm* — Clement Cheng

(57) ABSTRACT

An electric bed with a sliding block linkage has a head board, an inner frame, an outer frame, and a head supporting part. Two ends of the head supporting part are in rotatable connection with the head board and the outer frame. The inner frame is in sliding connection with the outer frame. The head board is in rotatable connection with the inner frame. A sliding block linkage has a driving device used for driving the inner frame to move relative to the outer frame. Relative sliding in a horizontal direction controls a horizontal movement distance of the head board. Optionally, the inner frame is positioned on the outer frame and movably connected with it by a sliding chute. The inner frame is driven by a motor to horizontally move relative to the outer frame.

12 Claims, 7 Drawing Sheets

SLIDING BLOCK LINKAGE FOLDING BED

This application claims priority from and is a Paris Convention Treaty of non-provisional application of: People's Republic of China utility model patent application 201310281317.2 entitled Electric Bed, filed Jul. 10, 2013, by inventor Xu, Jianchun; the disclosures of which are incorporated herein by reference.

FIELD OF THE INVENTION

The invention relates to a driving mechanism for an electric bed, specifically a lifting mechanism for a head board, and particularly a sliding block linkage for the electric bed.

BACKGROUND

With increasing extreme obesity and an aging population, the electric bed has become a popular piece of furniture. Nonetheless, most electric beds have a problem at present, namely a head bed, bed frame, or a bracket is away from a bed-rest at a certain distance when the head board raises, in which case, it is possible that some articles such as a pillow, and etc. would fall into the bed frame through the gap with the bed-rest. Additionally, when the head board rises, the position of the head changes relative to a bedside table, head and back is too far from the bed-rest, so it is possible to feel non-dependent. The aforementioned would impact on the conveniences and comfort of a user.

At present most electric beds use two methods to solve the above problems. The height of soft roll for the bed board is increased and elastic filling is extended toward the bed board to compensate for the distance from the bed-rest when the bed board rises at maximum angle. This method improves the above problems to some extent, but the distance from the bed-rest is not eliminated, many elastic materials are used, and appearance and shape are greatly limited.

The electric bed uses separate upper and lower bed frames. The upper bed frame is arranged in a lower bed frame guide rail by a bearing. The upper bed board and the lower bed board are attached with two flexible woven belts. When the head board is raised, the upper bed frame is pulled up by the woven belts to move toward the bed-rest, so that the head board keeps a certain distance from the bed-rest. It should be mentioned that this woven belt method was a break through. Nonetheless, this method had many defects and limitations. First, the structure and stress features limited use of the head board during beginning a raising stage. In order to solve this problem, most electric beds have a sectioned structure. The woven belts are loosened so that they pull the upper bed frame till the head board is raised at 20-30°. Thus the distance is not controlled during the beginning raising stage of the head board, and the woven belts are loose, causing uncontrolled risks such as twisting and knotting. Secondly, as the flexible woven belts bear tensile force only, it is impossible to solve the problem that the upper bed frame slides by force toward the bed-rest.

SUMMARY OF THE INVENTION

The technical problem to be solved by the invention is to provide a sliding block linkage for the electric bed. The sliding block linkage has a seasonable structure, eliminates the defects of the head board lifting structure of a traditional electric bed, effectively controls the distance between the head board and the bed-rest, and improves the comfort of the electric bed.

In order to solve the above problems, the invention provides a sliding block linkage for the electric bed, comprising a head board, an inner frame, an outer frame, and further comprising a head supporting part. Two ends of the head supporting element are respectively in rotatable connection with the head board and the outer frame. The inner frame is in sliding connection with the outer frame and the head board in rotatable connection with the inner frame. The sliding block linkage further comprises a driving device used for driving the inner frame to move relative to the outer frame. For example relative sliding in horizontal direction to control the horizontal movement distance of the head board.

Furthermore, the inner frame is positioned on the outer frame and movably connected with it by a sliding chute. The inner frame is driven by a motor to horizontally move relative to the outer frame. The head board is an arc-shaped rod comprising an arc-shaped sliding chute. The inner frame comprises a hinge pin. The arc-shaped rod is positioned on the side of the inner frame and another end is connected with the bottom of the head board. The hinge pin is arranged on the side of the inner frame and is positioned in the arc-shaped sliding chute of the arc-shaped rod.

Furthermore, the sliding block linkage further comprise a pull rod. An arc-shaped elongated slot is arranged in the middle of the head board. One end of the pull rod is hinged with the side of the inner frame, and another end is hinged in the arc-shaped elongated slot of a crank.

Furthermore, the head supporting element is the crank or the rocker and made of plastic.

Furthermore, the driving device is a driving motor, which is connected with the outer frame and the head board, so that the inner frame moves relative to the outer frame.

Selectively the driving device may be a rotating motor, which is connected with the head supporting element, and the rotating motor rotates the head supporting part to drive the whole linkage to move.

Furthermore, the distance between the connecting points of the head board, the head supporting part, and the inner frame is approximately equal to the length of Scott-Russell straight-line mechanism.

The sliding block linkage has a seasonable structure, eliminates the defects of the head board lifting structure of a traditional electric bed, effectively controls the distance between the head board and the bed-rest, and improves the comfort of the electric bed.

Figure 1:
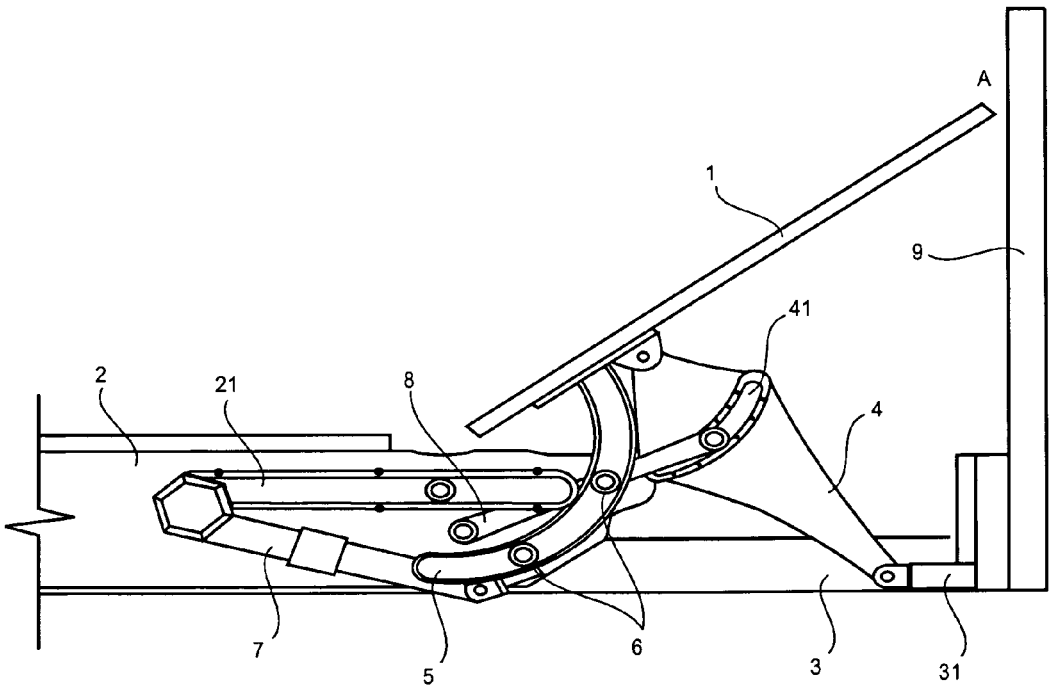
FIG. 1 is a schematic diagram of the crank sliding block linkage according to the invention.
Figure 2:
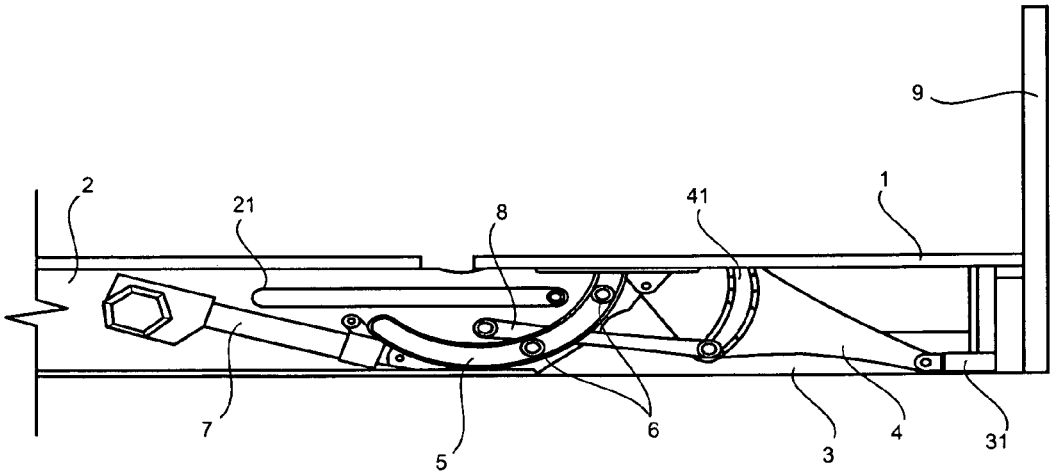
FIG. 2 is a schematic diagram of the sliding block linkage in horizontal position of the head board.
Figure 3:
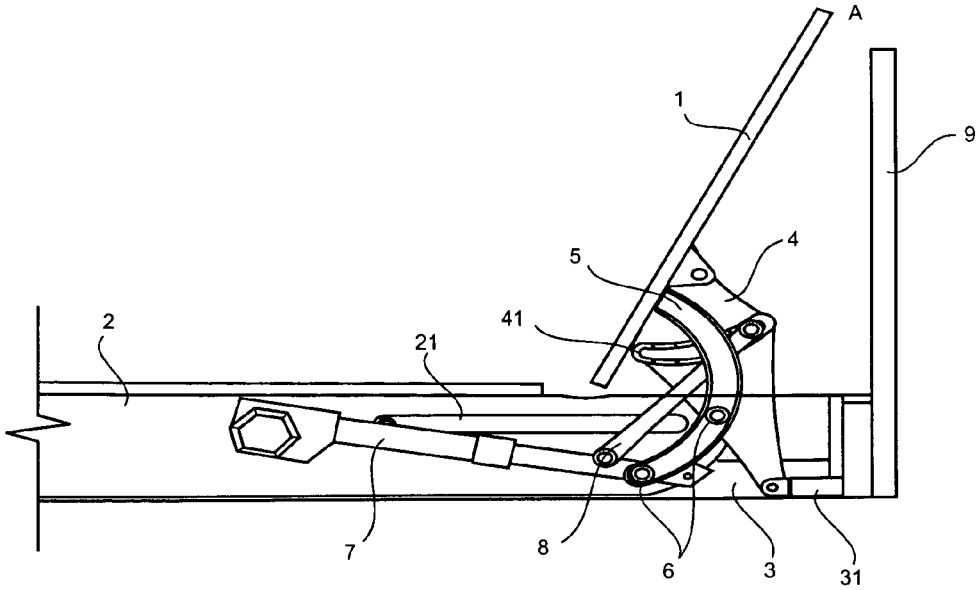
FIG. 3 is a schematic diagram of the sliding block linkage in top position of the head board.

The following call out list of elements can be a useful guide in referencing the elements of the drawings.

1 Head Board
2 Inner Frame
3 Outer Frame
4 Head Supporting Part/Crank Sliding Block Linkage
5 Arc-shaped Rod
6 Two Hinge Pins
7 Push Rod
8 Pull Rod
9 Bed Back Post
21 Sliding Chute
31 Front End
41 Arc-shaped Elongated Slot

DETAILED DESCRIPTION OF THE PREFERRED EMBODIMENTS

As shown in FIG. 1, FIG. 2, FIG. 3 and FIG. 4, the crank sliding block linkage 4 for the electric bed according to the invention comprises the head board 1 (in this embodiment, the head board provided with the bed board), the inner frame 2 and the outer frame 3. The inner frame 2 is positioned on the outer frame 3 and movably connected with it by the sliding chute 21. The inner frame 2 is driven by the motor to horizontally move relative to the outer frame 3. The crank sliding block linkage further comprises the head supporting part 4 (e.g. the crank), the push rod 7 (linear motor) and two hinge pins 6.

The head supporting part 4 can be a sliding block linkage formed as a crank 4. The head supporting part 4 is a generic name for the sliding block linkage, which in turn is a generic name for the crank 4. The crank 4 is the sliding block linkage, which is the head supporting part 4. The crank 4 is a part that supports the head by raising the headboard.

The head board may comprise the arc-shaped rod 5, with the arc-shaped sliding chute. Two ends of the crank 4 are respectively hinged with the front end 31 of the outer frame 3 and the bottom of the head board 1. The arc-shaped rod 5 is positioned on the side of the inner frame 2 and another end is connected with the bottom of the head board 1. Two hinge pins 6 are arranged on the side of the inner frame 2, and are positioned in the arc-shaped sliding chute of the arc-shaped rod 5. One end of the push rod 7 is hinged with the side of the inner frame 2, while another end is movably connected with another end of the arc-shaped rod 5.

Selectively, the driving device of the linkage may be the rotating motor (not shown in the figure) (used for driving the inner frame or the head supporting plate), which is connected with the crank 4 in lieu of the push rod 7. The motor drives the crank 4 to drive the whole linkage to move and lift the head board.

Furthermore, the linkage further comprises the pull rod 8, the arc-shaped elongated slot 41 is arranged in the middle of the crank 4, one end of the pull rod 8 is hinged with the side of the inner frame 2 and another end is hinged in the arc-shaped elongated slot 41 of the crank 4. The arc-shaped elongated slot 41 of the crank 4 allows the user's head to rise straight up instead of in an arc shaped manner. The pull rod 8 and the arc shaped elongated slot 41 are sized according to the geometry of the head board 1 so that their cooperation provides a vertical line path for point A.

Specifically, the head board 1 and the inner frame 2 of the linkage are connected with a revolute pair, which is achieved by relative sliding of the hinge pin 6 in the arc-shaped sliding chute of the arc-shaped rod 5. The center of rotation is equivalent to the circle center of the arc-shaped rod 5. The push rod 7 (the driving motor) is connected with the arc-shaped rod 5 by a sliding pair. When the motor operates, the arc-shaped rod 5 is driven by the push rod 7 to move between two position limited by two hinge pins 6. At the same time, the headmember 1 is driven by the arc-shaped rod 5 to rotate in the position limited by the crank 4; wherein, the head board 1, the inner frame 2, the outer frame 3, and the crank 4 form a four-bar linkage sliding mechanism (Scott-Russell straight-line mechanism). The head board 1 is driven to rotate by the push rod 7. Thus the inner frame 2 is driven to move toward the bed-rest 9 to control the distance between the highest point A and the bed-rest 9 during rotation of the head board 1. Selectively, in the four-bar linkage sliding mechanism, the push rod 7 may be replaced by the rotating motor (not shown in the figure), and the rotating motor is connected with the crank 4. When the crank 4 is driven to rotate by the rotating motor, movement between the connecting rod and the slider may be achieved to to lift the head board. Of course, the driving modes are not limited to the above two modes; other driving mode may be used as long as change of the driving modes results in movement of the crank sliding block linkage.

Theoretically, when the length and relative positions of the connecting points of the inner frame 2, the outer frame 3, the head board 1 and the crank 4 meet the specific relationship of Scott-Russell straight-line mechanism, the linkage becomes a straight-line mechanism.

The head board 1 does not displace in left and right directions at the highest point A. The above relationship may be adjusted to ensure that the displacement of the head board 1 in left and right directions at the highest point A is less than certain set value, thus an approximate straight-line mechanism is obtained, and this is an expected requirement of the linkage. In fact, this approximate straight-line mechanism is more generally used to meet the other structure requirement of the electric bed in actual applications.

The crank 4 of the linkage is used as the main connection between the inner and outer frames of the electric bed. The inner frame 2, the outer frame 3, the head board 1, and the crank 4 form a crank (rocker) sliding block straight line or approximate straight-line movement mechanism. In actual applications, when the rotating angle of the head board 1 is larger, the point A displaces at a distance toward the left, after the highest point A of the head board 1 is biased toward the left. Therefore, the pull rod 8 is added between the inner frame 2 and the crank 4. The pull rod 8 is connected with the inner frame 2 by the revolute pair. The pull rod 8 is in a plane higher pair connection with the head board 1 by the crank 4, thereby effectively improving the rigidity of the whole linkage and solving the problem of displacement in horizontal direction when the force towards the left is applied.

Figure 4:
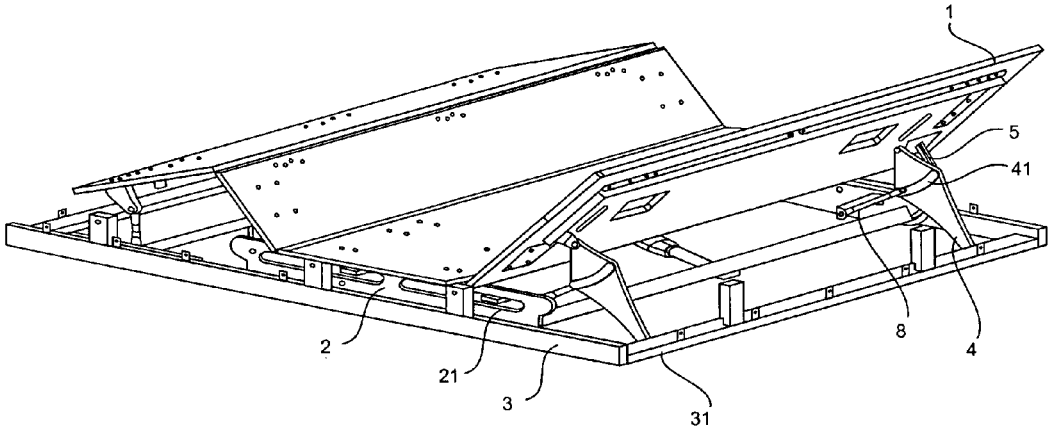
FIG. 4 is a schematic diagram of actual application of the sliding block linkage in the electric bed.
Figure 5:
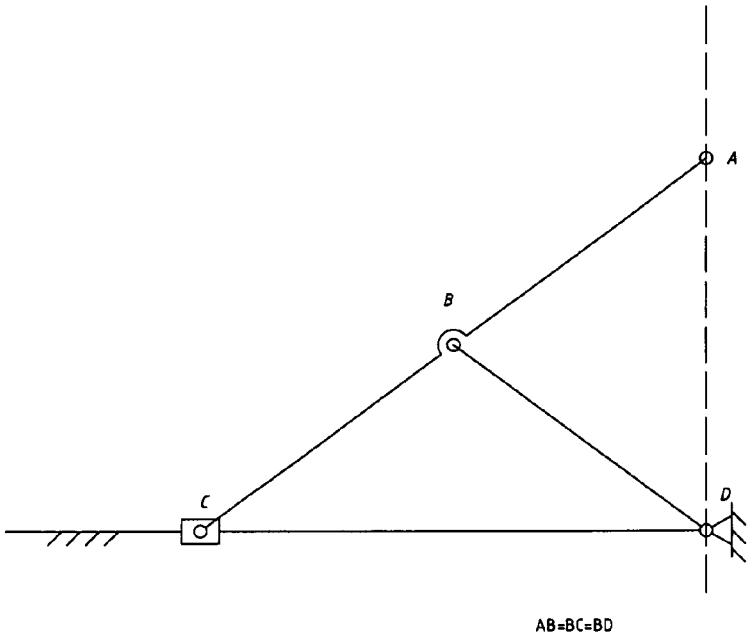
FIG. 5 is an abstract geometric diagram of the sliding block linkage mechanism.
Figure 6:
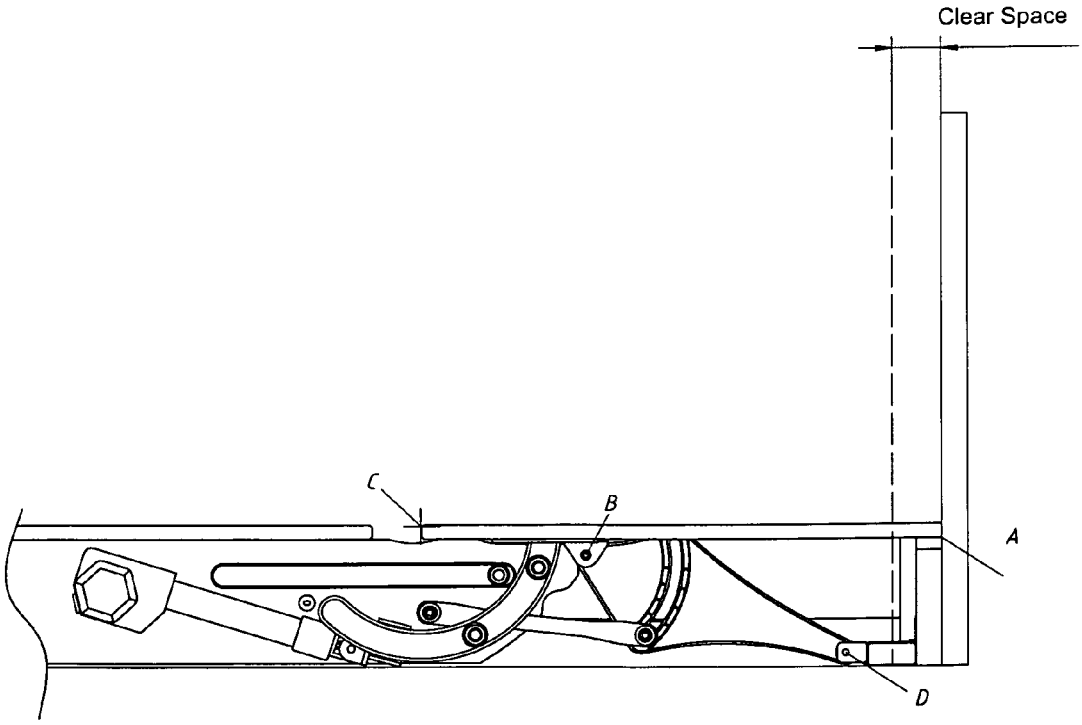
FIG. 6 is a side view geometric diagram of the sliding block linkage mechanism in the lowered position.
Figure 7:
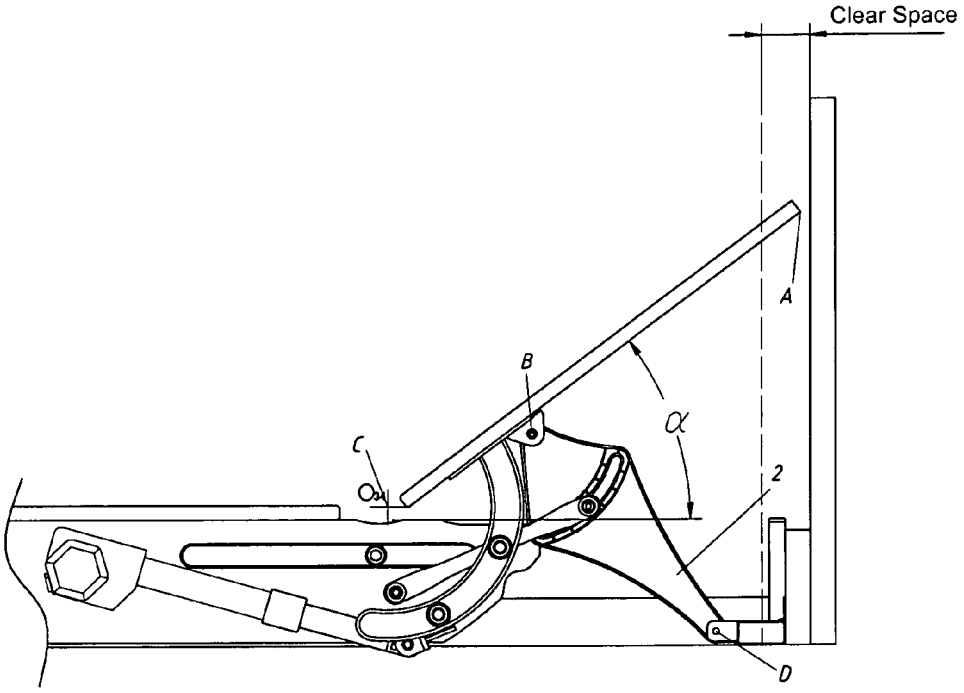
FIG. 7 is a side view geometric diagram of the sliding block linkage mechanism in the half raised position.
Figure 8:
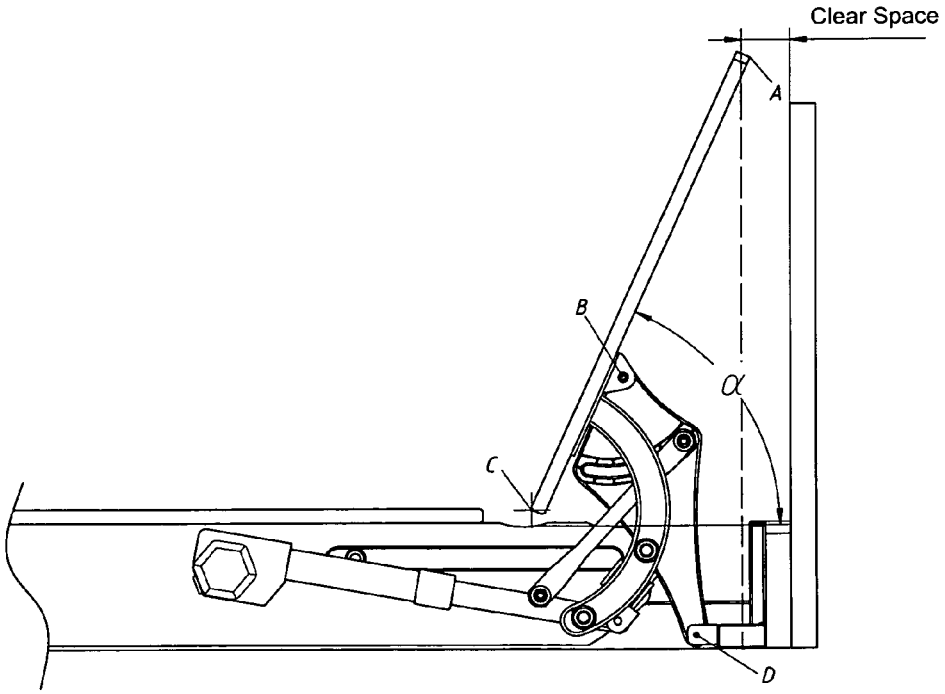
FIG. 8 is a side view geometric diagram of the sliding block linkage mechanism in the fully raised position.
Figure 9:
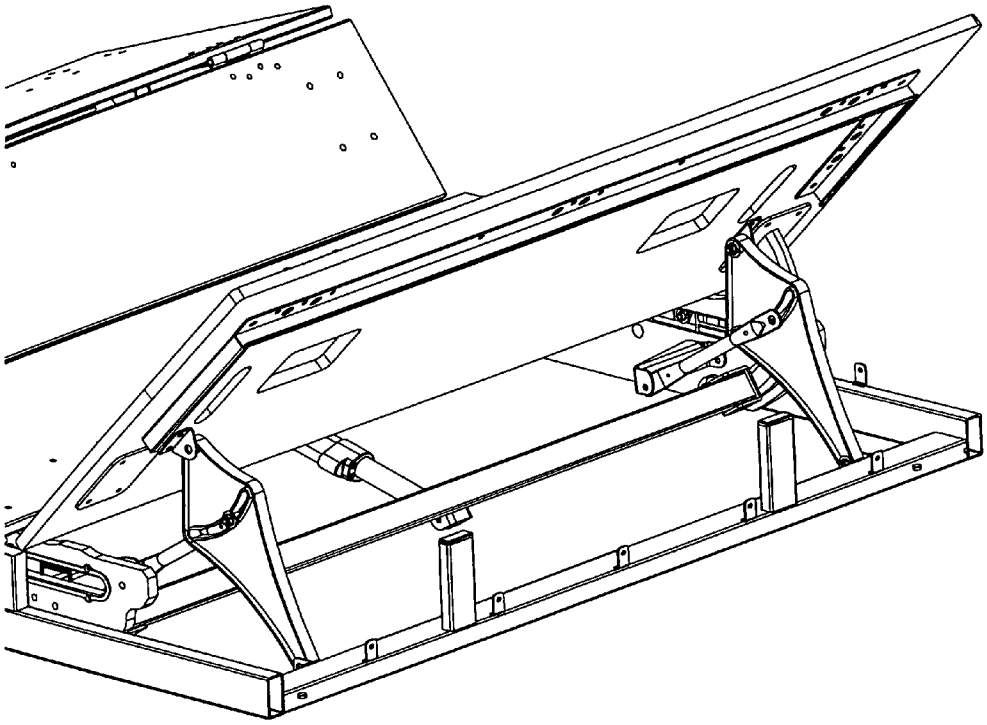
FIG. 9 is a detail perspective zoom view of the sliding block linkage mechanism in the half raised position.
Figure 10:
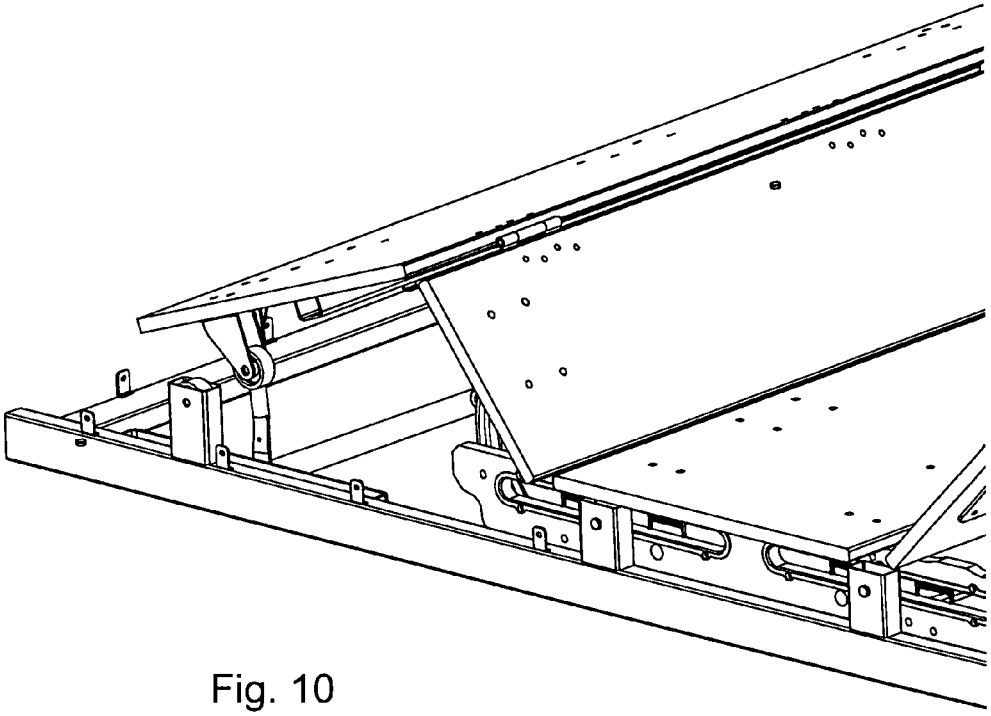
FIG. 10 is a detail perspective zoom view of the calf board and thigh board mechanism.

The linkage may be respectively arranged on two sides of the head board of the electric bed (in FIG. 4, the arc-shaped rod on one side of the electric bed is not shown). The highest point A of the head board has a straighter track and is controllable through the whole process unlike when the upper and lower frames are pulled by the flexible woven belts or other structure of the prior art traditional electric bed.

The above embodiment is only used as living example and does not limit the scope of the invention. A person skilled in the art may find other embodiments with the same function within the scope of the claims as stated below.

The invention claimed is:

1. An electric bed with a sliding block linkage comprising:

a. a head board;

b. an inner frame;

c. an outer frame;

d. a head supporting part, wherein two ends of the head supporting part are in rotatable connection with the head board and the outer frame, wherein the inner frame is in sliding connection with the outer frame and the head board is in rotatable connection with the inner frame; and e. a sliding block linkage comprising a driving device used for driving the inner frame to move relative to the outer frame, wherein relative sliding in a horizontal direction controls a horizontal movement distance of the head board wherein, the inner frame is positioned on the outer frame and movably connected with it by a sliding chute, wherein the inner frame is driven by a motor to horizontally move relative to the outer frame, wherein the sliding block linkage further comprises a pull rod, wherein an arc-shaped elongated slot is arranged in the middle of the head board, wherein one end of the pull rod is hinged with the side of the inner frame, and another end is hinged in the arc-shaped elongated slot of a crank.

2. The electric bed with a sliding block linkage of claim 1, wherein the head supporting element is the crank or the rocker and is made of plastic.

3. The electric bed with a sliding block linkage of claim 1, wherein the driving device is a driving motor, which is connected with the outer frame and the head board, so that the inner frame moves relative to the outer frame.

4. The electric bed with a sliding block linkage of claim 1, wherein the driving device is a rotating motor, which is connected with the head supporting element, wherein and the rotating motor rotates the head supporting part to drive the sliding block linkage to move.

5. The electric bed with a sliding block linkage of claim 1, wherein the distance between the connecting points of the head board, the head supporting part, and the inner frame is approximately equal to the length of a straight-line mechanism.

6. The electric bed with a sliding block linkage of claim 1, wherein, the head board is an arc-shaped rod comprising an arc-shaped sliding chute.

7. An electric bed with a sliding block linkage comprising:

a. a head board;

b. an inner frame;

c. an outer frame;

d. a head supporting part, wherein two ends of the head supporting part are in rotatable connection with the head board and the outer frame, wherein the inner frame is in sliding connection with the outer frame and the head board is in rotatable connection with the inner frame; and e. a sliding block linkage comprising a driving device used for driving the inner frame to move relative to the outer frame, wherein relative sliding in a horizontal direction controls a horizontal movement distance of the head board, wherein, the inner frame comprises a hinge pin, wherein an arc-shaped rod is positioned on the side of the inner frame and another end is connected with the bottom of the head board, wherein the hinge pin is arranged on a side of the inner frame and is positioned in an arc-shaped sliding chute of the arc-shaped rod.

8. The electric bed with a sliding block linkage of claim 7, wherein the sliding block linkage further comprises a pull rod, wherein an arc-shaped elongated slot is arranged in the middle of the head board, wherein one end of the pull rod is hinged with the side of the inner frame, and another end is hinged in the arc-shaped elongated slot of a crank.

9. The electric bed with a sliding block linkage of claim 7, wherein the head supporting element is the crank or the rocker and is made of plastic.

10. The electric bed with a sliding block linkage of claim 7, wherein the driving device is a driving motor, which is connected with the outer frame and the head board, so that the inner frame moves relative to the outer frame.

11. The electric bed with a sliding block linkage of claim 7, wherein the driving device is a rotating motor, which is connected with the head supporting element, wherein and the rotating motor rotates the head supporting part to drive the sliding block linkage to move.

12. The electric bed with a sliding block linkage of claim 7, wherein the distance between the connecting points of the head board, the head supporting part, and the inner frame is approximately equal to the length of a straight-line mechanism.

* * * * *